US006164639A

United States Patent [19]

Toh et al.

[11] Patent Number: 6,164,639

[45] Date of Patent: Dec. 26, 2000

[54] APPARATUS AND METHOD FOR MEASURING A DIMENSION OF AN OBJECT

[75] Inventors: Chiew Teng Toh; King Ling Julius Goh; Eng Guan Yeo, all of Singapore, Singapore

[73] Assignee: Hewlett-Packard Company, Palo Alto, Calif.

[21] Appl. No.: 09/227,233

[22] Filed: Jan. 8, 1999

[30] Foreign Application Priority Data

Sep. 11, 1998 [SG] Singapore ..... 9803607-2

[51] Int. Cl.[7] ..... B65H 1/00

[52] U.S. Cl. ..... 271/171; 271/265.01; 271/265.02; 356/4.07; 356/383; 356/384; 250/559.19; 250/559.24

[58] Field of Search ..... 271/265.01, 171, 271/265.02; 356/4.07, 384, 383; 250/559.19, 559.27, 559.24

[56] References Cited

U.S. PATENT DOCUMENTS 3,813,166 5/1974 Mary ..... 356/28

5,573,236 11/1996 Petocchi et al. .

*Primary Examiner*—Donald P. Walsh
*Assistant Examiner*—Jonathan R. Miller

[57] ABSTRACT

A method and apparatus for measuring a dimension of an object which utilizes a reflective photosensor and a facing reflective surface, wherein the spacing between the sensor and the reflective surface is varied depending on the dimension to be measured. The preferred application of the invention is in a sheet feeder for a printer wherein the invention provides an electrical signal indicative of the size of sheets in the sheet feeder. The electrical signal may be used to control a printing function. The sheet feeder (10) includes a base (14) having a paper guide (18) slideably mounted thereon. The guide (18) carries a tapered arm (26) which includes a reflective surface (28). A reflective photosensor (30) is fixedly mounted on the base opposite the reflective surface (28) such that the variable distance between the sensor (30) and the surface (28) as the paper guide (18) is adjusted gives a correspondingly variable electrical output from the sensor. When the sensor (30) is adjusted against the edge of a stack of sheets, the sensor's output represents a dimension of those sheets.

14 Claims, 4 Drawing Sheets

APPARATUS AND METHOD FOR MEASURING A DIMENSION OF AN OBJECT

TECHNICAL FIELD

This invention relates to apparatus and a method for measuring a dimension of an object and has particular application to measuring a dimension, such as the width or length, of a sheet. The invention will be particularly described hereunder in relation to its use in a sheet feeder, that is, a unit for supporting sheets for feeding to a printer. Usually the sheets will be paper, but the invention is useable for other types of sheets, for example transparencies. Although the invention is to be described in relation to this particular application, it is to be understood that it can be otherwise applied for measuring a dimension of other suitable objects.

BACKGROUND

Printers with which the invention, as applied to a sheet feeder, is useable, which may be for example of the electrophotographic, ink jet or laser jet type, are generally designed to print on a number of different sheet sizes. These sizes are standardized and include legal, letter, A3, A4, B5 and others. Known sheet feeders such as trays, containers or cassettes for printers are able to accommodate different sizes of sheets by including sheet size guides which are manually adjustable to fit a desired sheet size. Commonly, an operator knows the size of the sheets stored in a sheet feeder and appropriately formats the printer driver or copying machine for that size. A more desirable arrangement, however, would be to sense automatically the sheet size and generate an electrical signal which can be used to control a printing function related to the sheet size. For example, a signal which is representative of the size of sheets in a sheet feeder could be forwarded to a printer driver for the driver to determine whether the sheet size is appropriate for the image to be printed. Should the image not be compatible with the sensed sheet size, the printing can be altered and/or a signal sent to the operator to correct the matter. Another more intelligent option is for the signal to initiate an automatic scaling of an image to fit onto the sheet size which is in the sheet feeder.

U.S. Pat. No. 5,573,236 discloses a sheet storage tray which is adapted to detect the size of sheets in the tray. This adaptation comprises the provision of an optical reflective sensor and a continuously variably graduated scale associated with a sheet guide. Movement of the sheet guide in the tray causes the scale to be moved past the sensor. When the guide is located against a stack of sheets, the sensor generates a signal having a strength which is determined by the relative position of the scale. Thus the strength of the signal is representative of the position of the guide and thus the size of the sheets.

There are a number of problems with the arrangement disclosed in U.S. Pat. No. 5,573,236. First, it requires a specially prepared continuously variably graduated scale. Example scales which are disclosed are a grey scale which varies from black to white with levels of grey therebetween, a continuous colour pattern that varies in colour from end to end, a variably transparent scale and binary scales to give digital signal outputs. Second, as the sensor is movable relatively along the continuously variably graduated scale at a constant spacing, and as an "electrical output v. level of light sensed" characteristic curve for the reflective sensors concerned are not normally determined for such a scale and a constant measurement distance, and given such sensors can vary significantly in performance from sensor to sensor, a special calibration of each unit to determine a curve of output v. light for the particular sensor and the particular scale in that unit is required. Thus a relatively complex calibration on every unit is required and this adds to the expense of a unit. Also the scales are expensive to manufacture, and the performance of the prior art arrangements depend on the consistency with which the patterns or markings are made on such scales. They are also prone to degradation through contamination with dirt and dust etc. and thus lose accuracy, which problem is dealt in U.S. Pat. No. 5,573,236 by the provision of a wiper operatively associated with the sensor to clean the scale as it moves past the sensor. Some of these types of scales also require the use of special sensors to suit the scale in question, for example if the scale is a digital type scale.

SUMMARY OF THE INVENTION

The present invention provides apparatus and a method for measuring a dimension of an object which involves the provision of two elements, one of which includes an electro-optical sensor for transmitting and receiving an optical signal and the other of which includes a reflective surface. The elements are arranged such that the reflective surface faces and is variably spaced from the electro-optical sensor according to different adjustment positions for one of the elements whilst the other is stationary. The adjustable element is positionable against a portion of the object and this position represents the dimension of the object which is to be measured. The spacing between the sensor and the reflective surface at this position, which can be correlated to the dimension being measured, is then determinable from the strength of the reflected optical signal and thus the magnitude of an electrical output signal from the sensor. Thus the output of the sensor provides a measure of the dimension of the object, that is, the invention relies on a variation in the distance between an electro-optical sensor and a reflective surface associated with an element as the element moves relative to the sensor to produce a variation in an electrical output signal of the sensor. Thus a particular distance as determined by a particular size of the object being measured will generate a particular magnitude for the signal which is related to the object size.

Preferably the object is a sheet for passage through a printer and the adjustable element is a guide for an edge of the sheet. Thus, in this preferred application of the invention, the portion of the object against which the adjustable element is positionable is an edge of the sheet. This application avoids the use of a continuously variably graduated scale as such as in the prior art. That is, the prior art scale is replaced by a simpler and thus less costly solution.

Preferably, the direction of adjustment of the adjustable element and the dimension being measured are parallel and extend substantially orthogonally to a path of the optical signal between the electro-optical sensor and the reflective surface. This arrangement allows for a much reduced optical path length compared to the dimension being measured.

Manufacturers of the electro-optical sensors which the invention employs, which are preferably reflective photosensors, normally characterize their sensors' "relative output v. distance" relationship, that is, their output electrical signal strength v. distance between the sensor and a reflective surface. Given the specification of this relationship by a manufacturer, substantial variations in the characteristic between sensors do not occur and thus a sheet feeder which employs the invention can be designed to indicate sheet size based on the manufacturer's specified performance data. Thus although some calibration will still be needed, the need to develop a performance characteristic as for the arrangement of U.S. Pat. No. 5,573,236 is avoided.

Furthermore, it is not envisaged that any additional treatments to enhance the reflectivity of the reflective surface of the element concerned will be required other than the normal formation operations for that element. That is, the reflectivity can be ensured merely by the provision of a normally smooth surface provided the material of the element is appropriate. This material can be a plastics having a light colour. Effectively the surface provides a substantially constant reflectivity throughout its length.

Preferably the first element comprises a sheet guide which carries an arm. This sheet guide may be slidably mounted relative to a base of a sheet feeder such that the arm moves lengthwise past the sensor. The arm may be tapered along its length such that the reflective surface is provided by a surface of the arm which slopes relative to the sensor. Alternatively the arm may be stepped along its length to define reflective surface sections wherein each section is differently spaced from the sensor.

Alternatively the first element may comprise a sheet guide which carries the electro-optical sensor and the second element is an arm which is stationary relative to the base. The arm may be tapered or stepped relative to the sensor as described above. In this arrangement, the sensor is mounted with the sheet guide such that it is moved by the guide lengthwise of the arm.

The above described arrangements are appropriate for detecting a single dimension, that is, the length or width of a sheet on a sheet feeder. Two such arrangements can be used to detect both dimensions, that is, length and width of a sheet.

Embodiments of the invention will now be described, by way of non-limiting example only, with reference to the accompanying drawings.

DESCRIPTION OF PREFERRED EMBODIMENTS

Figure 1:
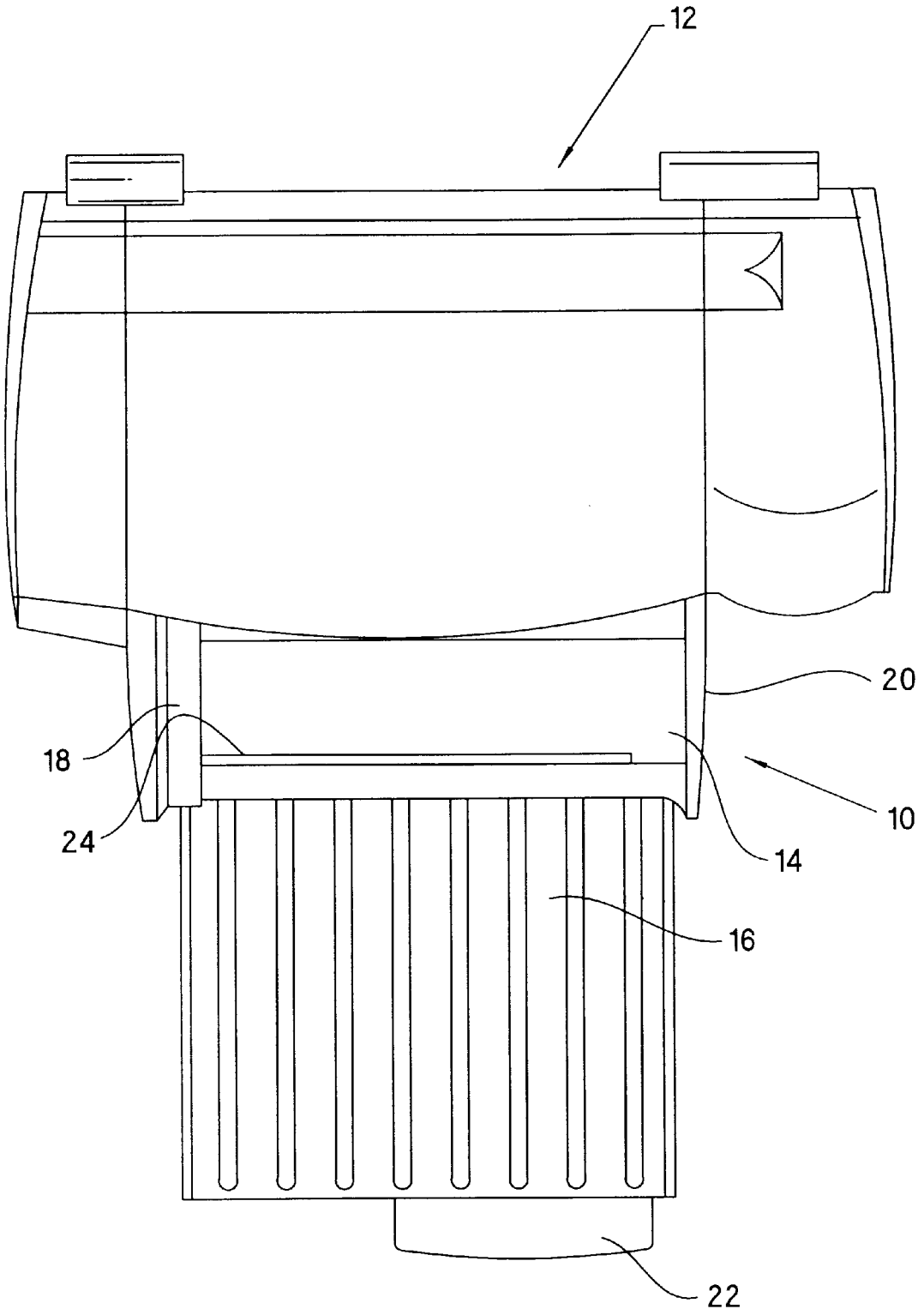
FIG. 1 illustrates a top plan view of a printer having a sheet feeder which utilizes one embodiment of the invention.

Referring to FIG. 1, a sheet feeder 10 is for holding a stack of sheets (not shown) from which individual sheets can be fed for passage through a printer indicated generally by reference 12. The function of the sheet feeder 10 is to locate the sheets, for example of paper, accurately for presentation to the printer's pick-up mechanism (not shown). The sheet feeder 10 comprises a base 14 to which a plate 16 having a paper stopper is attachable in a known manner. A stack of sheets rests on the upper surfaces of the base 14 and plate 16. A paper guide 18 is adjustable widthwise of base 14 until it comes into contact with the edge of the stack of paper. The base 14 includes a fixed paper guide 20 such that the adjustment of movable guide 18 against the paper edge locates the paper between guides 18 and 20. The plate 16 is then movable lengthwise until its paper stopper 22 comes into contact with the "rear" edge of the stack of papers. This locates the paper lengthwise relative to the printer 12.

Figure 2:
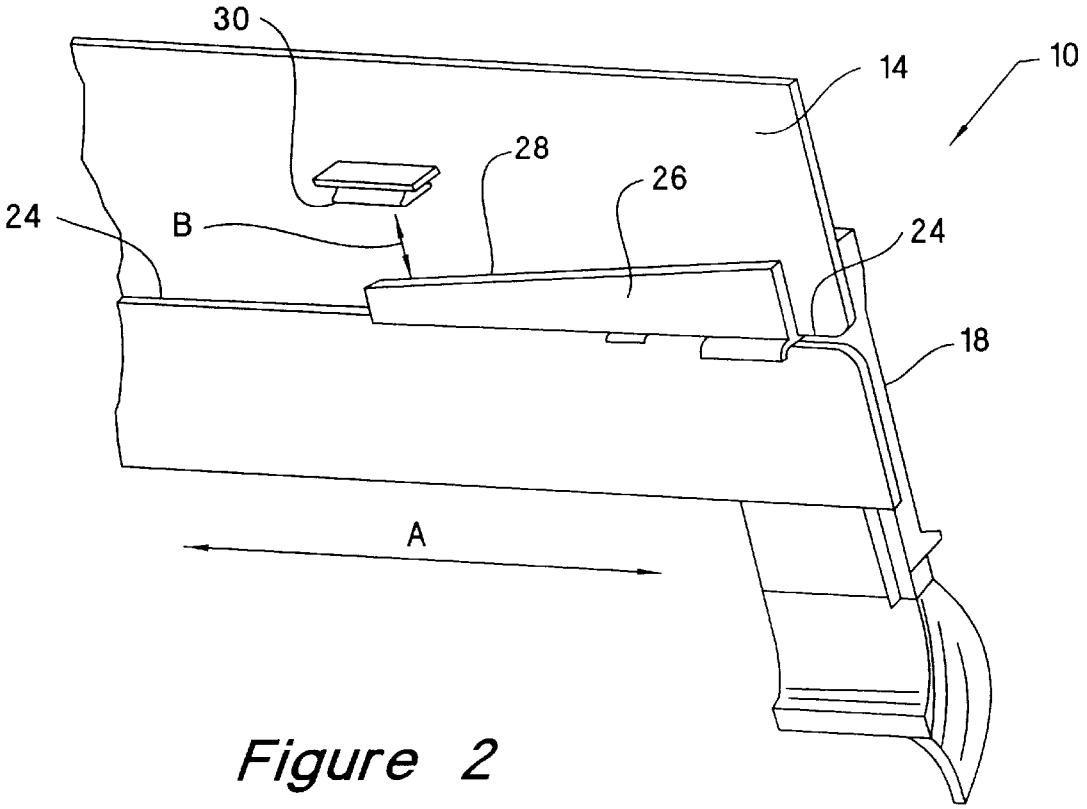
FIG. 2 is an underneath perspective view of a portion of a sheet feeder of the FIG. 1 printer.

The underneath view represented by FIG. 2 shows a portion of base 14 and the movable guide 18. The guide 18 is mounted for movement along a slot 24 in base 14 and includes an arm 26 attached thereto. Thus movement of guide 18 moves arm 26 in the direction shown by arrow A. Arm 26 extends widthwise of base 14 in close proximity to its undersurface and includes a tapered surface 28. Surface 28 is reflective and faces a reflective photosensor 30 which is fixedly mounted to the undersurface of the base 14. The guide 18 and tapered arm 26 assembly comprise a first element of the invention that is associated with the base 14 and the reflective photosensor 20 is a second stationary element associated with the base 14.

Reflective photosensor 30 transmits an optical signal towards surface 28 and receives the reflected optical signal therefrom as represented by arrow B which illustrates the path distance of the optical signal. Movement of guide 18 widthwise of the base 14 correspondingly moves tapered arm 26 past optical sensor 30 such that the path length B is varied. This causes the strength of the reflected optical signal and thus the electrical signal output of the sensor 30 to vary. This variation can be related to the position of the paper guide 18 and thus the width of the sheets on the base when the guide 18 is in contact with their edge. Thus the sensor 30 provides an electrical output signal which represents a dimension of a sheet supported on the base 14 when the guide arm 18 is adjusted to a position in contact with an edge of the sheet.

An example reflective photosensor 30 which can be used is manufactured by Rohm under the designation RPR-359F.

Figure 3:
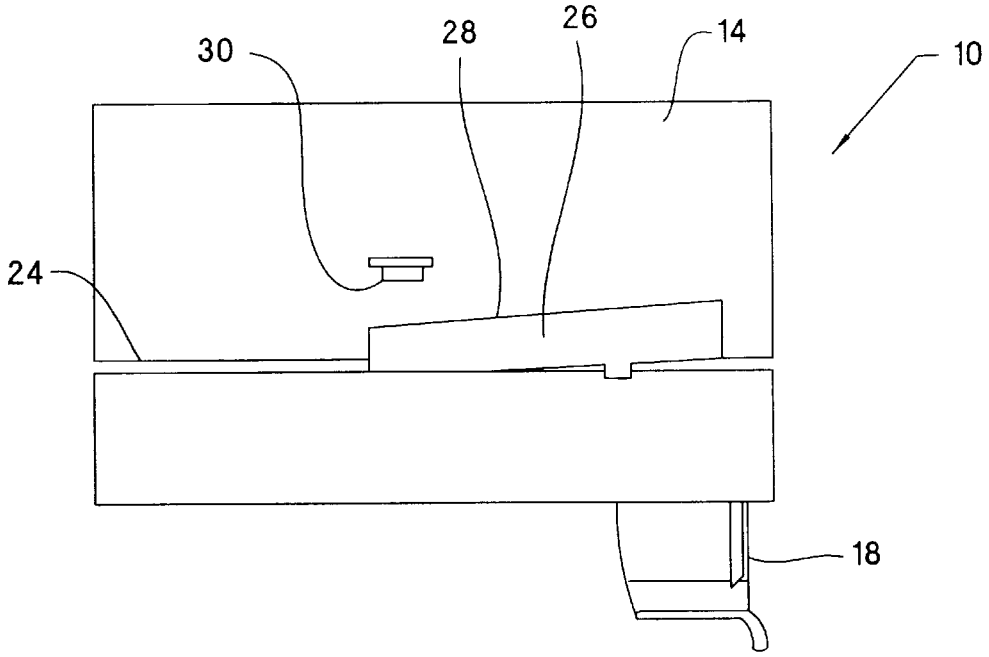
FIG. 3 is a plan view from underneath of the sheet feeder portion shown in FIG. 2.
Figure 4:
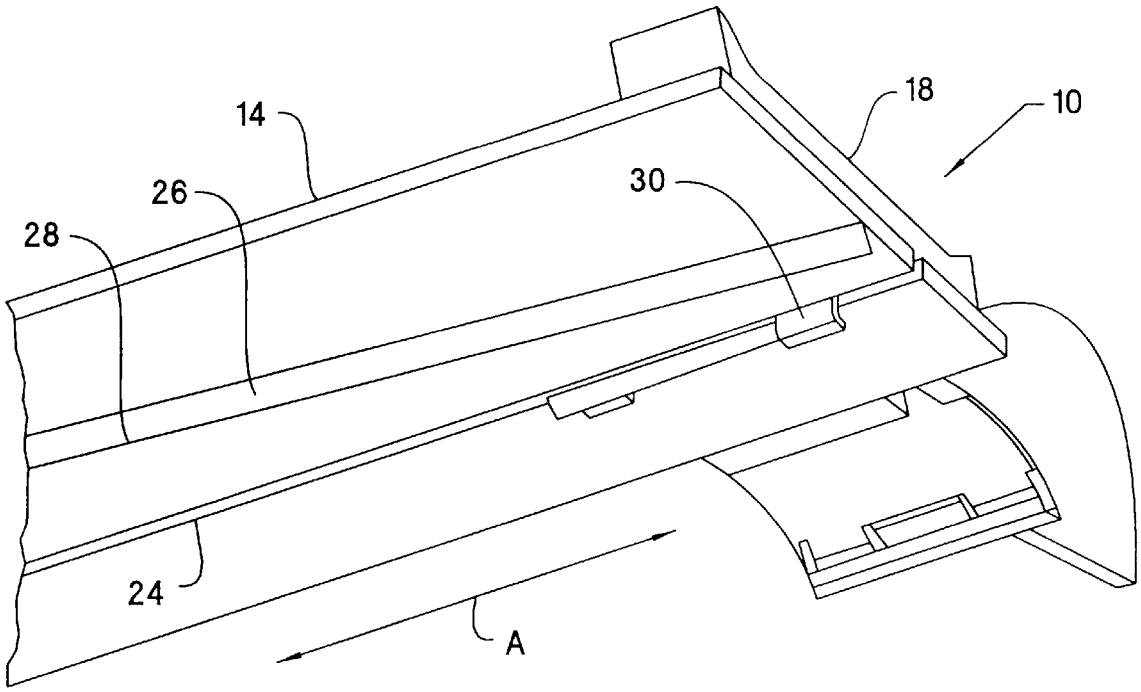
FIG. 4 is a view similar to FIG. 2 of portion of another sheet feeder embodiment.
Figure 5:
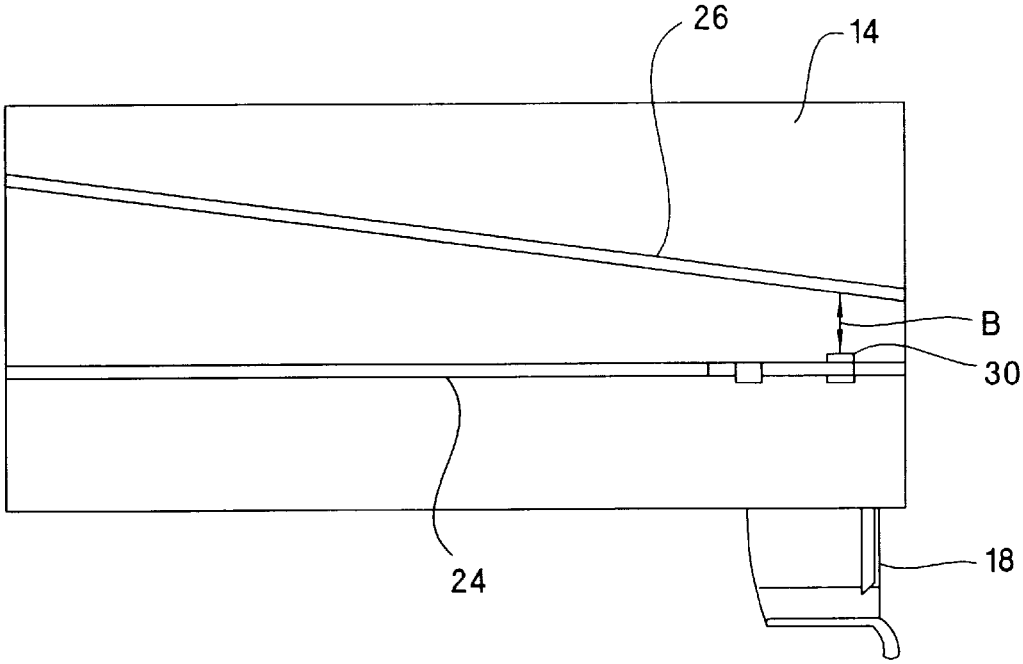
FIG. 5 is a view from underneath of the sheet feeder portion of FIG. 4.
Figure 6:
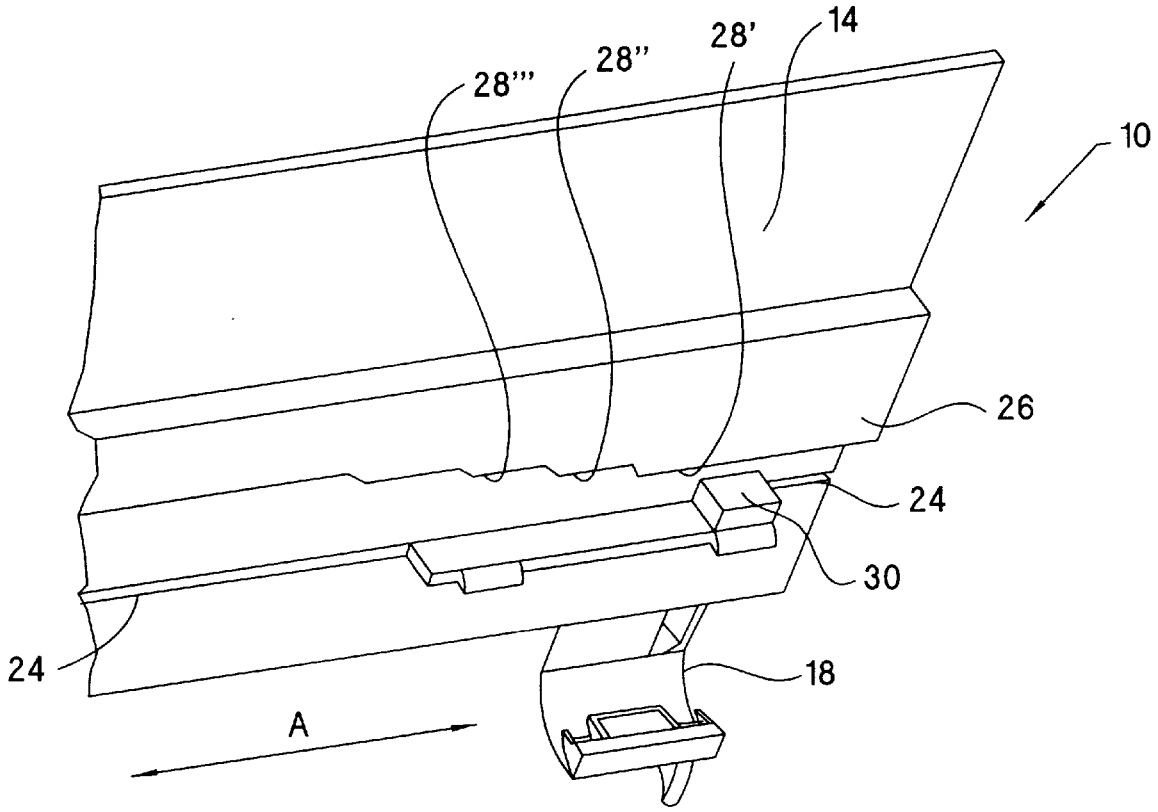
FIG. 6 is a view similar to FIG. 2 of portion of yet another sheet feeder embodiment.

In the embodiments shown by FIGS. 4, 5 and 6, corresponding elements to those of the FIGS. 2 and 3 embodiment have been accorded the same reference numeral. The difference between the embodiment of FIGS. 4 and 5 and the previous embodiment is that the tapered arm 26 is fixed relative to the base 14, and the sensor 30 is attached to the guide 18 and is thus movable relative to the base 14. The functioning of this embodiment is the same as that of FIGS. 2 and 3.

FIG. 6 illustrates a modification similar to that of the FIGS. 4 and 5 embodiment but wherein the arm 26 is stepped along its length instead of being tapered, to provide a number of reflective surface sections 28', 28", 28'" etc. Each reflective surface section 28', 28", etc. is spaced a fixed distance from the sensor 30 and location of the sensor opposite a particular section 28', 28", etc. will give an electrical output signal which represents sheets of a particular size. It is also within the scope of the invention that the stepped arm 26 can be movable and the sensor 30 stationary (similar to the FIGS. 2 and 3 embodiment).

The above described embodiments are for measuring a "width" dimension of the sheets. A similar arrangement can be associated with the movable plate 16 for measuring a "length" dimension of the sheets such that signals representing the width and length of sheets on the sheet feeder can be generated for forwarding to a printer driver or other print controlling portion of a printing machine.

The invention described herein is susceptible to variations, modifications and/or additions other than those specifically described and it is to be understood that the invention includes all such variations, modifications and/or additions which fall within the spirit and scope of the following claims.

What is claimed is:

1. Apparatus for measuring a dimension of an object comprising:

a first element which is adjustable to different positions to contact a portion of the object, a second element which is stationary relative to the object, wherein one of the first and second elements includes an electro-optical sensor for transmitting and receiving an optical signal and the other of the first and second elements includes a tappered arm having a length, wherein a surface of the arm which is sloped relative to the electro-optical sensor provides a reflective surface, the reflective surface facing and being spaced from said electro-optical sensor, wherein the spacing between said reflective surface and said electro-optical sensor is variable according to different adjustment positions of the first element such that the strength of an optical signal reflected from the reflective surface and received by the sensor relative to a transmitted optical signal is correspondingly variable, whereby the electro-optical sensor provides an electrical signal which is a measure of a dimension of the object when the first element is adjusted to a position in contact with said portion thereof.

2. Apparatus as claimed in claim 1, wherein the electro-optical sensor is a reflective photosensor, wherein the first element is adjustable in a direction which is substantially orthogonal to a path of the optical signal between the reflective photosensor and the reflective surface.

3. Apparatus as claimed in claim 2, wherein the first element includes the arm, and wherein the second element is the reflective photosensor, wherein the first element is adjustable in a direction along the length of the arm.

4. Apparatus as claimed in claim 1 wherein the object is a sheet for passage through a printer and the first element is a guide for the sheet, wherein said portion of the object is an edge of the sheet, wherein the apparatus includes another guide for an opposite edge of the sheet and said first element is adjustable towards and away from said another guide.

5. Apparatus for measuring a dimension of an object comprising:

a first element which is adjustable to different positions to contact a portion of the object, a second element which is stationary relative to the object, wherein one of the first and second elements includes an electro-optical sensor for transmitting and receiving an optical signal and the other of the first and second elements includes an arm having a length, wherein the arm is stepped along its length to define reflective surface sections wherein each section faces and is variably spaced from the electro-optical sensor according to different adjustment positions of the first element such that the strength of an optical signal reflected from the reflective surface sections and received by the sensor relative to a transmitted optical signal is correspondingly variable, whereby the electro-optical sensor provides an electrical signal which is a measure of a dimension of the object when the first element is adjusted to a position in contact with said portion thereof.

6. A sheet feeder for a printer comprising, a base for supporting a sheet for passage through the printer, a first element associated with the base and which is adjustable to different positions to contact an edge of the sheet, a second element associated with the base and which is stationary relative thereto, wherein one of the first and second elements includes an electro-optical sensor for transmitting and receiving an optical signal and the other of the first and second elements includes a reflective surface which faces and is spaced from said electro-optical sensor, wherein the spacing between said reflective surface and said electro-optical sensor is variable according to different adjustment positions of the first element such that the strength of an optical signal reflected from the reflective surface and received by the sensor relative to a transmitted optical signal is correspondingly variable, whereby the electro-optical sensor provides an electrical signal which represents a dimension of the sheet on the base when the first element is adjusted to a position in contact with an edge of said sheet.

7. A sheet feeder as claimed in claim 6, wherein the electro-optical sensor is a reflective photosensor, wherein the first element is adjustable in a direction which is substantially orthogonal to a path of the optical signal between the reflective photosensor and the reflective surface.

8. A sheet feeder as claimed in claim 7, wherein the first element comprises a sheet guide and an arm having a length, and wherein the second element is the reflective photosensor, wherein the arm is attached to the sheet guide and the sheet guide is mounted for sliding movement relative to the base for adjustment in a direction along the length of the arm.

9. A sheet feeder as claimed in claim 8 wherein the arm is tapered such that the reflective surface is provided by a surface of the arm which is sloped relative to the reflective photosensor.

10. A sheet feeder as claimed in claim 8 wherein the arm is stepped along its length to define reflective surface sections wherein each section is differently spaced from the reflective photosensor.

11. A sheet feeder as claimed in claim 7 wherein the first element comprises a sheet guide and the reflective photosensor, and wherein the second element is an arm having a length which extends in said substantially orthogonal direction of adjustment of said first element, wherein the sheet guide is mounted for sliding movement relative to the base and the reflective photosensor is mounted thereon, wherein the sheet guide includes a contact surface and is adjustable along said substantially orthogonal direction for its contact surface to contact said edge of said sheet.

12. A sheet feeder as claimed in claim 11 wherein the arm is tapered such that the reflective surface is provided by a surface of the arm which is sloped relative to the reflective photosensor.

13. A sheet feeder as claimed in claim 11 wherein the arm is stepped along its length to define reflective surface sections, wherein each reflective surface section is differently spaced from the reflective photosensor.

14. A sheet feeder as claimed in claim 6 wherein the first and second elements are arranged such that said electrical signal represents a width for said sheet, wherein a third element corresponding with said first element and a fourth element corresponding with said second element are associated with the base to produce a second electrical signal representative of a dimension of said sheet, wherein the third and the fourth elements are arranged such that said second electrical signal represents a length for said sheet.

* * * * *